US007784258B2

(12) United States Patent
Hess

(10) Patent No.: US 7,784,258 B2
(45) Date of Patent: Aug. 31, 2010

(54) ROPE-LIKE STRUCTURE

(75) Inventor: Ruedi Hess, Tegerfelden (CH)

(73) Assignee: Textilma AG, Stansstad (CH)

( * ) Notice: Subject to any disclaimer, the term of this patent is extended or adjusted under 35 U.S.C. 154(b) by 970 days.

(21) Appl. No.: 10/591,254

(22) PCT Filed: Mar. 1, 2005

(86) PCT No.: PCT/CH2005/000115

§ 371 (c)(1),
(2), (4) Date: Aug. 31, 2006

(87) PCT Pub. No.: WO2005/085518

PCT Pub. Date: Sep. 15, 2005

(65) Prior Publication Data

US 2007/0137163 A1 Jun. 21, 2007

(30) Foreign Application Priority Data

Mar. 2, 2004 (CH) ..... 0345/04
Feb. 17, 2005 (CH) ..... 0280/05

(51) Int. Cl.
*D02G 3/02* (2006.01)

(52) U.S. Cl. ..... 57/210

(58) Field of Classification Search ..... 57/210
See application file for complete search history.

(56) References Cited

U.S. PATENT DOCUMENTS 2,600,395 A 6/1952 Domoj et al.
4,170,076 A 10/1979 Müllner et al.
4,192,127 A 3/1980 O'Neil et al.
4,640,178 A 2/1987 Kurzböck
6,410,140 B1 * 6/2002 Land et al. ..... 428/377
7,360,477 B2 * 4/2008 Hess ..... 87/6
2003/0070413 A1 * 4/2003 Fujiwara et al. ..... 57/210

FOREIGN PATENT DOCUMENTS

| | | |
|---|---|---|
| AT | 358 433 | 1/1980 |
| DE | 25 41 763 A1 | 3/1977 |
| DE | 40 38 161 A1 | 6/1992 |
| FR | 334 887 | 8/1903 |
| GB | 891 741 | 3/1962 |
| WO | 03/027383 A1 | 4/2003 |

* cited by examiner

*Primary Examiner*—Shaun R Hurley
(74) *Attorney, Agent, or Firm*—Buchanan Ingersoll & Rooney PC

(57) ABSTRACT

A rope-like structure, such as a core-spun rope, a cord or a rope, disclosed wherein the individual fibers, threads, strands and/or cords are provided in the form of longitudinal fibers of a longitudinal fiber structure which are joined to another fiber which extends in a substantially crosswise manner or at any particular angle in relation to the longitudinal fibers, such that the longitudinal fibers of the longitudinal fiber structure are mutually non-slip and essentially cannot move backwards in relation to each other, wherein the other fibers are untied, at least on one occasion, in relation to the longitudinal fibers and the latter are thus retained thereby.

32 Claims, 7 Drawing Sheets

ROPE-LIKE STRUCTURE

CROSS-REFERENCE TO RELATED PATENT APPLICATIONS

This application claims the benefit under 35 U.S.C. §119 of Swiss Patent Application No. 345/04, filed Mar. 2, 2004 and Swiss Patent Application No. 280/05, filed on Feb. 17, 2005 and is a continuation under 35 U.S.C. §120 of International Application No. PCT/CH2005/000115, the disclosures of which are incorporated herein in their entireties by reference.

BACKGROUND

A rope-like structure is disclosed.

U.S. Pat. No. 4,640,178 discloses a core rope which combines a host of core fiber bundles as a core and which is surrounded by an intermediate jacket. Around the intermediate jacket is a braided, outside jacket of monofilament yarn. The core, intermediate jacket and jacket are not connected among one another and therefore slip mutually.

U.S. Pat. No. 4,170,076 discloses a core rope having a braided core which is formed for its part by a host of core fiber bundles. The core is likewise surrounded by a braided jacket. The core and jacket are not connected between one another and thus are not slip-proof. In use, thickened and thinned areas form.

WO 03/027383 discloses a rope-like structure, especially core ropes, cords and ropes, in which the individual fibers, yarns or yarn strands are connected among one another such that they are mutually slip-proof. These rope-like structures have increased strength in stretching behavior and increased knot strength.

AT 358433 discloses a rope, especially a mountain-climbing rope, in a core-jacket construction in which the jacket threads are guided such that they lie as a braided pattern colored to the outside or lie on the core to the inside for better holding of the jacket. The core yarns are held by tubular braidings.

Furthermore, ropes with a core and a jacket or cords are known which are conventionally twisted or produced from different braided strands as hollow braiding without a core or from strands. In this way tubes can be formed with these cords on one end with so-called "splicing". These properties are valued and used mainly in sailing. But splicing can be complex and expensive.

Strings or thin cords are known as strings in a tennis racket; they are plaited round as a core with a fine yarn in order to obtain greater friction and strength. Likewise strings and fine cores are known which have a ribbed surface ('longitudinal-traverse' pattern) or another special structure to increase friction.

All of the foregoing documents are incorporated herein by reference in their entireties.

BRIEF DESCRIPTION OF THE DRAWINGS

Exemplary embodiments of the invention are detailed below using the figures.

DETAILED DESCRIPTION

A rope-like article or rope-like structure is disclosed in which the individual fibers, yarns or yarn strands are connected as longitudinal fibers among one another such that the fibers, yarns, or yarn strands are present mutually slip-proof.

Figure 1:
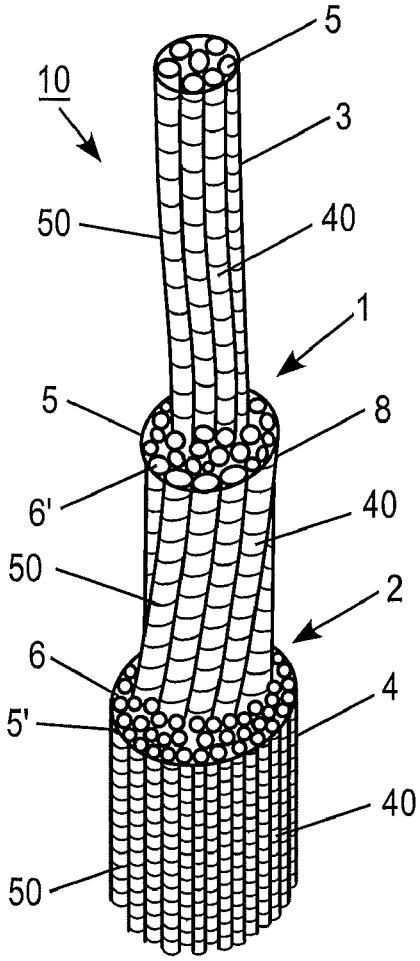
FIG. 1 shows a schematic structure of an exemplary core rope.

FIG. 1 shows the schematic structure of an exemplary core rope. The core rope 10 has an inner core area 1 and a jacket area 2 which surrounds it. The core area 1 comprises (e.g., consists of) at least one core 3 which is for its part formed from a host of fibers, yarns, yarn strands and/or at least one cord, and which are all designated as a so-called core fiber structure 5 below. The jacket area 2 comprises (e.g., consists of) a jacket 4, which for its part is formed from a host of fibers, yarns, yarn strands and/or at least one additional cord, and which are all designated as a so-called jacket fiber structure 6 below. In the core area 1 there can also be several cores, for example three or five, provided with core fibers and/or cores of the same or different type, with which the diversity of the core fiber structure 5 is shown. The similar also applies to the jacket fiber structure 6.

Core fiber structures 5 and jacket fiber structures 6 comprise (e.g., consist of) longitudinal fibers and are combined below as longitudinal fiber structures 40.

A portion of the core fiber structure 5, called core fibers 5', is present in the jacket area 2 and is connected in it to the jacket fibers of the jacket fiber structure 6, while a portion of the jacket fiber structure 6, called jacket fibers 6', is present in the core area 1 and connected in it to the core fibers 3. In this way the jacket is attached to at least one core mutually slip-proof. Several jackets with the most varied fibers can also be connected mutually slip-proof to at least one core. At least one other fiber 50 which lies essentially transversely to the longitudinal fiber structure 40, or a fiber bundle holds the longitudinal fibers in the longitudinal fiber structure 40 unable to slip against one another, or mutually together. Furthermore the expression 'fiber 50' also always means a fiber bundle below.

The fiber 50 to the longitudinal fiber structure 40 is essentially transversely diagonal to the longitudinal fibers and runs at almost any angle to them, but generally however at an angle which is less than 45°. But it can also be an angle from 45° to 90° or exactly 90°. Special arrangements of the fiber 50 are described below.

Slipping of the jacket on the core is a known, but highly undesirable property in core ropes, as already described. The described structure, on the one hand with mixing of core and jacket fibers and on the other hand by binding to traverse fibers, can prevent any slippage and therefore can offer advantages.

Advantageously it runs uniformly when running over carabineers, rollers, and rope dispensers. Neither thickened sites nor thin sites occur, as is conventional in jacket slippage. These core ropes can be used in place of twisted ropes.

The fibers can be materials such as PBO, polyolefin, polyamide, polyester, Dyneema, Aramid, Vectran and Zylon for high-strength applications, Aramid, Nomex and monofil yarns for heat-resistant and flame-resistant applications, polypropylene, polyamide, polyester and monofil yarns for UV-resistant, polypropylene monofil yarns for floating applications, and polyamide, polyester and monofil yarns for cut- and shear-resistant applications.

Traverse fiber bundles comprise (e.g., consist of) monofil, multifil or staple fibers. They can be twined, twisted or processed as parallel fiber bundles. Mixed fibers of different fibers can also be used. Any combination of individual fibers is conceivable.

Figure 2:
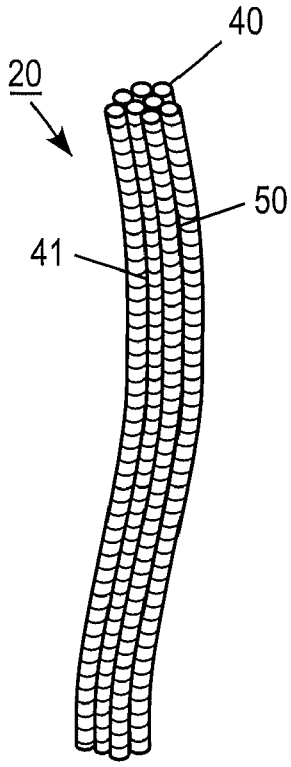
FIG. 2 shows the schematic structure of an exemplary cord as claimed in the invention.

FIG. 2 shows the schematic structure of an exemplary cord. The cord 20 has a longitudinal fiber structure 40 made from fibers, yarns, and/or yarn strands. The individual yarn strands are surrounded or bound with at least one other fiber 50 or a fiber bundle. It lies roughly transversely to the longitudinal fibers. The connection of the longitudinal fibers by means of the other fibers 50 is made such that it runs in the traverse direction, diagonal direction or some other selected angle to the longitudinal fibers.

Under the longitudinal fibers there is at least one longitudinal thread, or a longitudinal fiber 41 which is surrounded or enclosed by the fiber 50, the longitudinal thread or the longitudinal fiber 41 being held at a certain position within the longitudinal fiber structure 40. The fiber 50 is routed back after this position such that it surrounds other individual longitudinal fibers of the longitudinal fiber structure 40 individually, partially or entirely, and holds them in position, or holds them essentially stationary among one another without the capacity to slip or move.

A primary function of the exemplary fibers 50 or of the fiber bundle lies in this binding process. Of course the same fibers after "binding" can be routed further to the next binding site, for which the fiber generally runs parallel to the longitudinal fibers; this is equivalent to "offset" of the binding points. This continued routing of the fibers 50 is a secondary function; for this reason the designation "essentially traverse" seems appropriate. With this one or several fibers 50 a surface which appears differently is formed or achieved. The individual yarn strands and fibers which are used for this purpose and which can be different in thickness, strength, and color are connected essentially immovably to the longitudinal fibers of the longitudinal fiber structure 40.

A cord of this type looks similar to a conventional, twisted core, but can also have different materials and does not unravel or is resistant to unraveling; this can be a major advantage. Likewise it can be produced such that it looks similar to a braided cord. It can comprise (e.g., consist of) different fibers which are immovably connected against one another, but has higher strength with respect to a braided cord.

Figure 3:
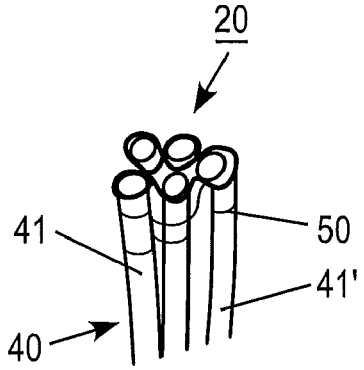
FIG. 3 shows a cord with reversed, additional traverse fibers.

FIG. 3 shows a cord 20 with a further traverse fiber 50 placed around the longitudinal fibers of the longitudinal fiber structure 40. The fiber 50, lying outside, surrounds one of the longitudinal fibers 41 at at least two points, in order to then be guided away or back in the direction of the core center from the outer surface of the cord, and in order to later reach the surface again between two longitudinal fibers and to surround another longitudinal fiber 41' or to be "wrapped" around it. The fibers 50 can be of different strength and extension. Some of the longitudinal fibers are made as so-called melt fibers which are melted with heat. Elastically made fibers can be likewise used.

Figure 4:
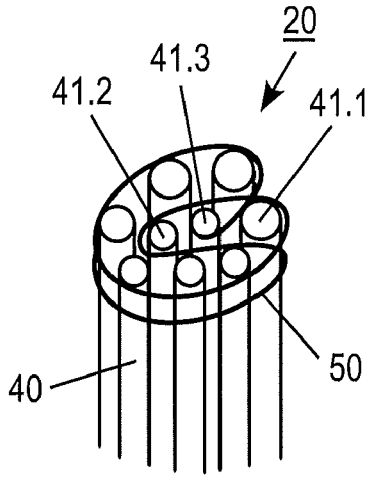
FIG. 4 shows cords with additional traverse fibers guided from the inside to the outside and from the outside to the inside.

FIG. 4 shows a core 20 with another traverse fiber 50 guided from the inside to the outside and from the outside to the inside. The fiber 50 runs over a larger part of the cord surface and is wrapped around the longitudinal fiber 41.1 of the longitudinal fiber structure 40, routed to the inside, wrapped around the longitudinal fibers 41.2 and 41.3 and routed to the outside to the surface of the cord in order to be routed again around the longitudinal fibers 41.1. The latter however takes place around the reverse direction. Each of the outside longitudinal fibers can assume the role of the longitudinal fibers 41.1 with respect to "wrapping". The choice of the next longitudinal fibers can take place in a strict sequence as the next or according to any, even stochastic pattern. The same applies to the choice of one of the inside longitudinal fibers 41.2 or 41.3, or one of the core fibers.

In this way the core fibers and the fibers and/or the yarn strands which form the jacket area are especially strongly bonded. A different stiffness or flexibility of the cords can be achieved in almost any way. Such a core is resistant to unraveling when cut.

Figure 5:
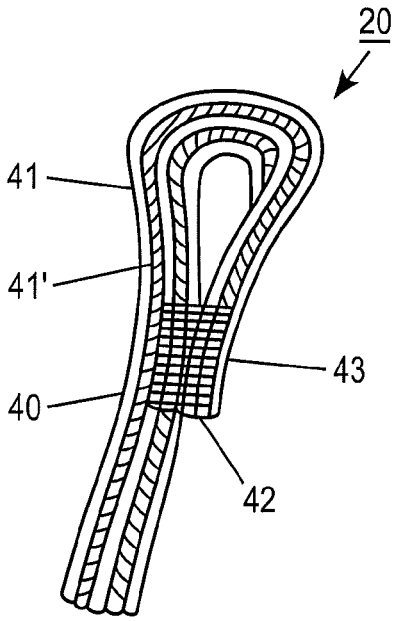
FIG. 5 shows cords with at least one high-strength longitudinal fiber.

FIG. 5 shows a cord with at least one high-strength longitudinal fiber. A cord 20 under the longitudinal fibers of the longitudinal fiber structure 40 has at least one other longitudinal fiber, or longitudinal thread 41, 41' which has much higher strength than the remaining longitudinal fibers. In this way extremely low stretching of the rope-like structure can be achieved. At the same time, the longitudinal threads 41, 41' form one or more sites 42 or areas within the longitudinal fiber structure 40 which have a much higher density and strength, by which also especially strong, reliable sewing 43 is enabled with low sewing loss. Moreover the sites 42 have less stretching.

Figure 6:
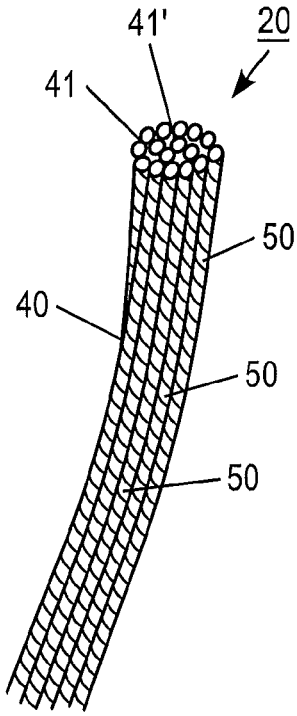
FIG. 6 shows a first exemplary embodiment of a core with several traverse melt fibers.

FIG. 6 shows a first embodiment of a cord with several traverse fibers, or fiber bundles. A cord 20 has several traverse fibers 50 to the longitudinal fibers of the longitudinal fiber structure 40 or yarn strands. Under the longitudinal fibers of the longitudinal fiber structure 40 there is at least one longitudinal thread 41, 41' with much higher elasticity and/or extension at at least one location within the longitudinal fiber structure. For this reason such a cord acquires special elasticity and ease of bending. The longitudinal fibers comprise (e.g., consist of) polyester, the traverse fibers of polyamide. Each of the outside longitudinal fibers is surrounded every 0.3-1.5 mm by a fiber 50 or is bound by it.

Such a cord 20 can be characterized by higher stretching and/or elasticity. The damping properties of such a cord are especially high. This is the case especially when it is worked into a dynamic rope as one of the core cords. In this connection cords are processed as a "finished product" or as a longitudinal yarn, longitudinal cord or longitudinal fiber structure into a core rope.

Figure 7:
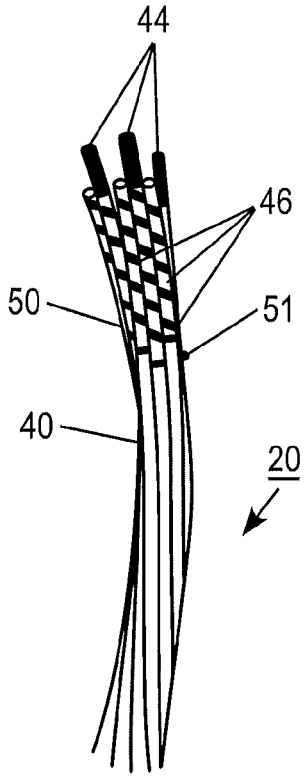
FIG. 7 shows a second exemplary embodiment of a core with several parallel fibers in longitudinal direction.

FIG. 7 shows a second embodiment of a cord with several parallel fibers in the longitudinal direction. A cord 20 under the longitudinal fibers of the longitudinal fiber structure 40 has at least one other longitudinal fiber 44 which are present as so-called melt fibers in the core and/or in the jacket. The traverse fibers 50 are present here partially likewise as melt fibers 51 of polyamide. The longitudinal fiber structure comprises (e.g., consists of) polyester in addition to these melt fibers. In heat, i.e., during heat treatment in the course of the production process or after it, these fibers melt at several locations 45 with the longitudinal fibers, by which much higher abrasion resistance of the individual fibers or yarn strands among one another or in the jacket area is achieved. In this connection the melt fibers 44 and 51 fuse with the other longitudinal fibers at sites 45. Moreover, the longitudinal fibers are present slip-proof after fusion. This results in much higher impregnation (for example with polyamide) and/or coating (polyamide).

Figure 8:
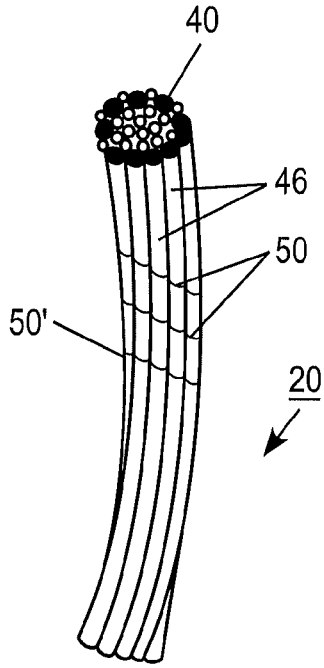
FIG. 8 shows a third exemplary embodiment of a cord with outside melt fibers.

FIG. 8 shows a third embodiment of a cord with outside melt fibers. A cord 20 under the longitudinal fibers of the longitudinal fiber structure 40 has other outside longitudinal fibers 46 which are made as melt fibers of polyamide PA 6 or polyamide PA 6.6 (Griion, Ems-Chemie, CH-7013 Domat/Ems). This yields an especially abrasion-resistant but flexible jacket after processing (among others, heat treatment). Other traverse fibers 50 are polyamide (melt fibers PA 6) which bind the longitudinal fibers every 2 mm in alternation.

The resulting cord properties are extremely high abrasion resistance and improved UV resistance. These cords can be used in rollers, winches, carabineers and clamps and have improved abrasion resistance.

One structure of a cord as described in FIG. 8 can also apply to a rope. In more general form the core and the jacket have the same or different longitudinal fibers of the longitudinal fiber structure 40. The outside longitudinal fibers 46 can be made at least partially as melt fibers. One at least additional traverse fiber 50 surrounds the outside longitudinal fibers 46 or binds them. At the same time, at least one second additional traverse fiber 50' is present as a melt fiber which surrounds the outside longitudinal fibers 46, or binds them. Melting of the longitudinal fibers 46 with the second additional traverse fiber 50' yields a fused jacket.

Figure 9:
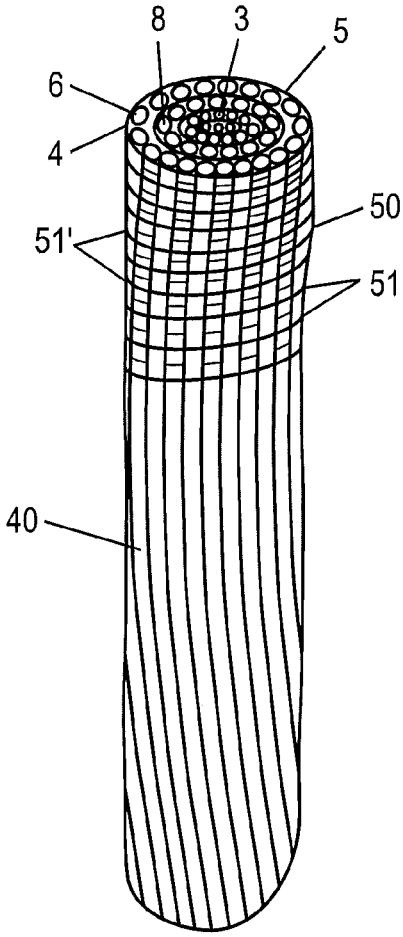
FIG. 9 shows a first exemplary embodiment of a core rope with an intermediate jacket and traverse additional fibers.

FIG. 9 shows a first embodiment of a core rope with an intermediate jacket and traverse additional fibers.

The core 3 has high-performance fibers in the core fiber structure 5 with fibers like polyamide (PA), polyester (PES), low-stretch polyester (PEN), Aramid, Dyneema, Vectran or Zylon. The intermediate jacket 8 comprises (e.g., consists of) so-called damping yarns such as monofil or elastic yarns which have a high compression property, while the jacket 4 comprises (e.g., consists of) jacket fibers in a jacket fiber structure 6, such as polyester or polyamide, which have high abrasion resistance, cutting resistance or edge strength.

The high-performance fibers of the core fiber structure 5 and the jacket fibers of the jacket fiber structure 6, also called longitudinal fibers of the longitudinal fiber structure 40, are covered or looped by additional roughly traverse fibers 50, some fibers 51 as entirely outside surrounding the longitudinal fibers, while other fibers 51' surround the longitudinal fibers only in alternation, i.e., only every other outside longitudinal fiber is bound. Polyamide can be used as fibers 51, 51'.

When at least one other fiber 50 has higher strength relative to the longitudinal fibers of the longitudinal fiber structure 40 and loops and binds the longitudinal fibers differently, a rope can be formed with higher bending strength and strength and thus higher stiffnes.

If the core comprises (e.g., consists of), for example, of high-strength Aramid fibers and one or in any case several jackets of heat-resistant Nomex fibers, the core rope is especially well suited for rescue applications as heat-resistant rope in firefighting and in the military.

Mixing or connection of the core fibers in at least one jacket area can be low, i.e. less than 3%. Here there need not be mixing of jacket fibers in the core area at the same time. But if this is the case, it is likewise considered low mixing, i.e. it is less than 3%. Core fibers are then in at least one jacket area, while jacket fibers are present connected in the core area. This applies to applications of currently used static and dynamic core ropes.

Figure 10:
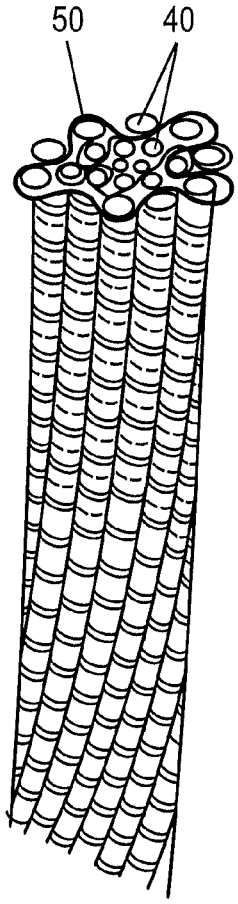
FIG. 10 shows a second exemplary embodiment of a core rope of the same materials of differing thickness and strength.

FIG. 10 shows a second embodiment of a core rope of the same materials of different thickness and strength. A core rope has longitudinal fibers 40, the outside jacket fibers being thicker than the core fibers. The outside jacket fibers are bound with the other fibers 50 in alternation. This yields higher strength in the jacket area. The rope can also have a surface which is similar to a twisted rope. Core and jacket fibers consist of polyester and the traverse fibers comprises (e.g., consists of) polyamide.

The longitudinal fibers of the longitudinal fiber structure 40 are generally present mixed as core and jacket fibers, the jacket fibers forming part of the core and the core fibers forming part of the jacket. They are at the same time bound by at least one other fiber 50 with higher strength with respect to the longitudinal fibers, the other fibers having a different thickness, strength or extensibility.

Figure 11:
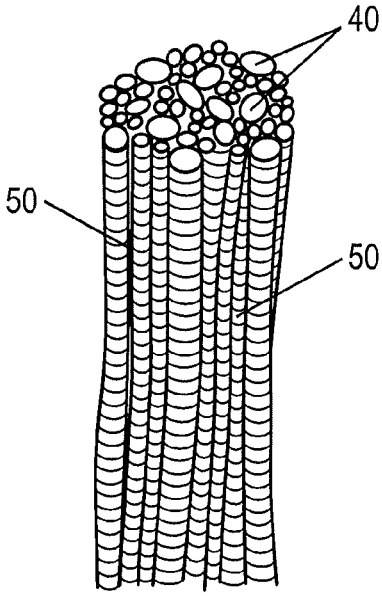
FIG. 11 shows a schematic structure of a low-stretch rope.

FIG. 11 shows the schematic structure of a low-stretch rope. The rope comprises (e.g., consists of) individuals fibers, yarns or yarns strands as longitudinal fibers of the longitudinal fiber structure 40, which are present or connected among one another such that the fibers, yarns or yarn strands are mutually slip-proof. At least one other traverse or crosswise running fiber 50 or fiber bundle binds the longitudinal fibers again and again, by which the longitudinal fibers are held mutually immovably, or stationary. In appearance it looks similar to a twisted or braided rope, but it has strength which is at least 10% higher in stretching behavior and knot strength at least 10% higher than conventional ropes. One positive property is that on the cut end it does not unravel or fringe. In this rope structure as many yarns as possible are present parallel or are additionally oriented or prestretched.

In these applications the fibers in the core area can be externally parallel and partially prestretched, while the fibers in the jacket area are arranged looping and thus are more flexible and resistant to abrasion and cutting and thus can also greatly increase UV resistance.

If at least one other fiber 50 has higher elasticity relative to the longitudinal fibers of the longitudinal fiber structure 40 and if it binds the longitudinal fibers, for a core of high-strength Aramid fibers and a jacket of heat-resistant Nomex fibers or abrasion-resistant, cut-proof and/or flame-proof, heat-resistant, acid-resistant or UV-resistant fibers and/or yarns, a typical firefighting rope results. Other typical applications can be found generally in rescue applications as a rope instead of steel cables, as a load rope with little alternate bending or as a replacement of twisted ropes.

But if the core has extremely high-strength fibers which are partially oriented or prestretched, and the jacket comprises (e.g., consists of) UV-resistant, abrasion-resistant and cut-resistant yarns and/or fibers, typical properties of a sailing sheet arise.

Figure 12:
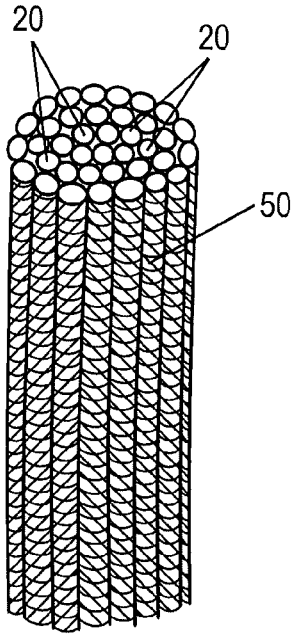
FIG. 12 shows a first exemplary embodiment of a rope with good damping properties.

FIG. 12 shows a first embodiment of a cable with especially fall-damping properties.

A rope can also be produced claimed in the invention to be as fall-damping as possible from yarns which comprise (e.g., consist of) as many fibrils as possible and form a cord 20, the core fiber structure being looped repeatedly with at least one other fiber 50 or a fiber bundle. Thus, for example a host of fibers 50, different in material and properties, can be used to surround one or more of the cores according to any pattern.

These cords can be used in the core of a rope. Due to the good damping properties achieved, this structure can be suited for dynamic mountaineering ropes. Due to the good fall-damping properties here mainly yarns of polyamide, polyester or POY yarns are used.

Figure 13:
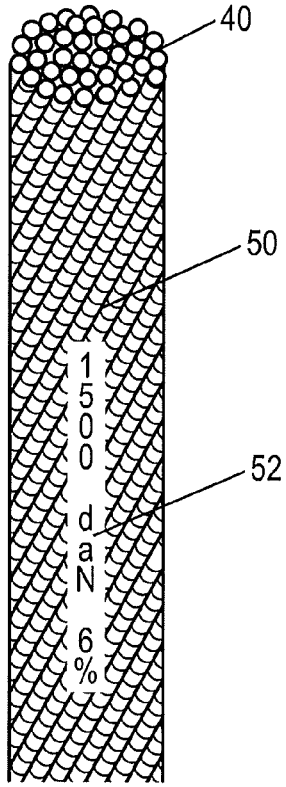
FIG. 13 shows a rope with lettering.

FIG. 13 shows a rope with lettering. In a longitudinal fiber structure 40 by means of at least one additional fiber 50 or a fiber bundle lettering 52 has been worked into the outer surface of the structure continuously in the lengthwise direction of the rope. Good readability is greatly supported by a skillful choice of colors of the fibers 50 and/or individual longitudinal fibers.

In addition to lettering, there can be marking of any type and/or for example center marking of the rope. This working can also take place in the traverse direction or at any angle to the longitudinal direction of the rope.

Figure 14:
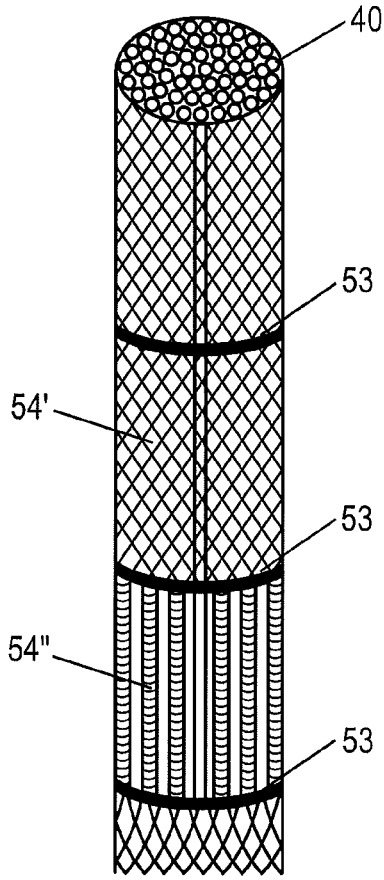
FIG. 14 shows a rope with continuous marking.

FIG. 14 shows a rope with continuous marking. In the longitudinal fiber structure 40, by means of at least one other fiber, continuous marking 53 has been worked into the outer surface of the structure of the rope. This is for example ring marking with continuous numbering. The surfaces of the intervals 54', 54" between the markings are identified like the markings 53 with a special choice of fibers 50 on the one hand and on the other by corresponding working into the structure of the surfaces. Thus, for example the surface of the interval 54' appears crosshatched and that of the interval 54' with broken lines lengthwise. This configuration of the rope surface can be advantageous and especially user-friendly.

Figure 15:
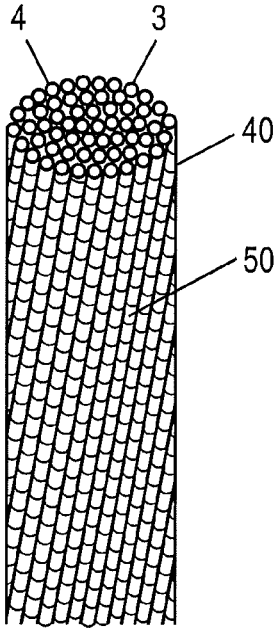
FIG. 15 the schematic structure of a climbing rope.

FIG. 15 shows the schematic structure of a sailing sheet or an extremely static high-performance rope. Ropes which are similar in appearance to braided, twisted ropes or similar construction or design can be produced instead of conventional core-jacket constructions of static high-performance ropes with extremely low stretching so that the extremely high-strength, high-performance fibers in the core are very parallel and have much reduced extension and higher tearing resistance, and thus static properties can be improved even with the same or reduced diameters. These longitudinal fibers of the longitudinal fiber structure 40 can be prestretched or predrawn. The fibers of the jacket can yield considerably more abrasion-resistant, less moisture-sensitive and more cut-resistant properties, the core 3 and jacket 4 being connected to one another by one or more threads or other fibers 50 which run in the other direction, such that even with the most varied fiber properties there is no jacket slip or additional stretching.

Figure 16:
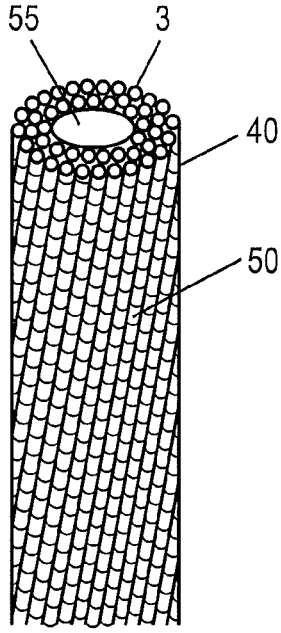
FIG. 16 shows a rope with a cavity.

FIG. 16 shows a rope with a cavity. A longitudinal fiber structure 40 in the core 3 has very high-strength, high-performance fibers with a much reduced stretching and higher tearing resistance which yield improved static properties even for the same or reduced diameters. These core fibers surround a cavity 55 which lies in the center of the core. The longitudinal fibers of the core, intermediate jacket and jacket are connected to one another by at least one other traverse fiber 50 such that jacket slip does not occur even with the most varied fiber properties. The intermediate jacket comprises (e.g., consists of) different or the same fibers as those of the core or jacket. This yields a soft-flexible structure which allows formation of a damping cushion or an air cushion under the jacket, and paired with abrasion-resistant, edge-strong, cut-proof fibers and fiber structures of the jacket has extremely improved edge strength. The fiber structure of the intermediate jacket has fine-structured, extremely small cavities or extremely small air bubbles. The cavity 55 is also called a "soft core middle point". The construction is similar in appearance to braided ropes. Such a rope is especially cut-proof and is also especially well suited to rescue applications of any type.

Figure 17:
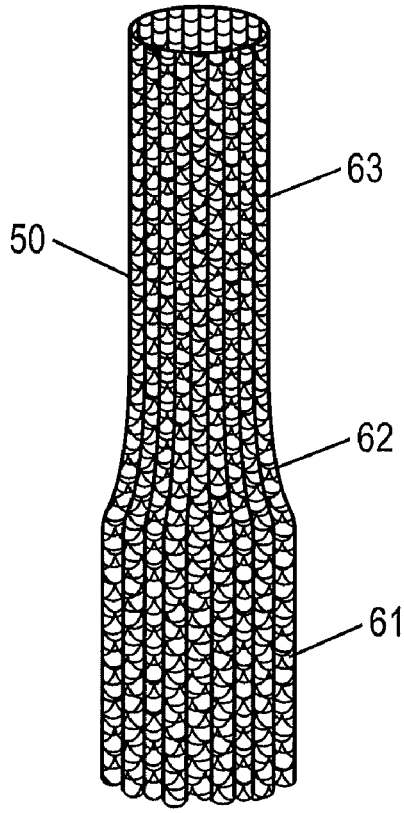
FIG. 17 shows a rope with a change of cross section.

FIG. 17 shows a rope with a change of cross section. A rope with an essentially round cross section 61 during the production process at at least one site 62 changes the cross section 63 to an oval or flat shape. At this point the rope can be for example better attached, sewn or clamped more easily. The cross section can change one time or repeatedly. Thus the oval shape can pass for example into a flat shape and later again into a round shape. The traverse fibers 50, or fiber bundles repeatedly bind the longitudinal fibers so that the rope seems surrounded by them in the manner of a net.

Cords and ropes of this type can be sewn and need not be spliced; this is a great simplification in fabrication for end connections.

The disclosed ropes can also be produced which are similar in appearance to a turned rope and in the core area comprise (e.g., consist of) other extreme high-loading fibers such as high-strength Aramid fibers or Vectran, Zylon. The protective jacket can comprise (e.g., consist of) fibers and/or yarns which form UV protection or an especially abrasion-resistant jacket. At the cut site this rope can be sewn and therefore need not be spliced. Moreover this rope does not unravel at the cut site. The embodiments of these core ropes are extremely diverse and cannot be definitively enumerated here.

Figure 18:
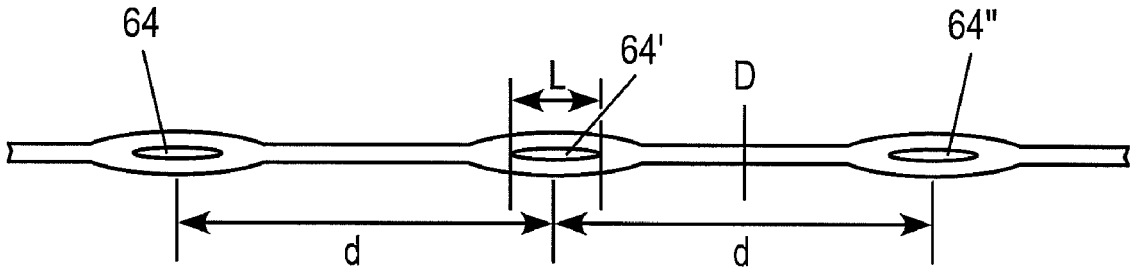
FIG. 18 shows a rope-like structure with openings.

FIG. 18 shows a rope-like structure, a cord or a rope which have openings 64, 64', 64" with slot lengths L in a predefined grid with spacing d. If the slot length L is roughly 3.5 times the diameter D of the undivided rope-like structure which is present braided as a 'one-piece', an especially advantageous arrangement arises. It becomes possible to loop back the one-piece through the openings 64, by which one loop is formed on one end of the rope-like structure. Repeatedly looping back under tension yields compaction of the loop, the loop no longer be able to open, similarly to a spliced end. The grid can however also be selected arbitrarily, i.e., the distances d then follow one another irregularly.

Figure 19:
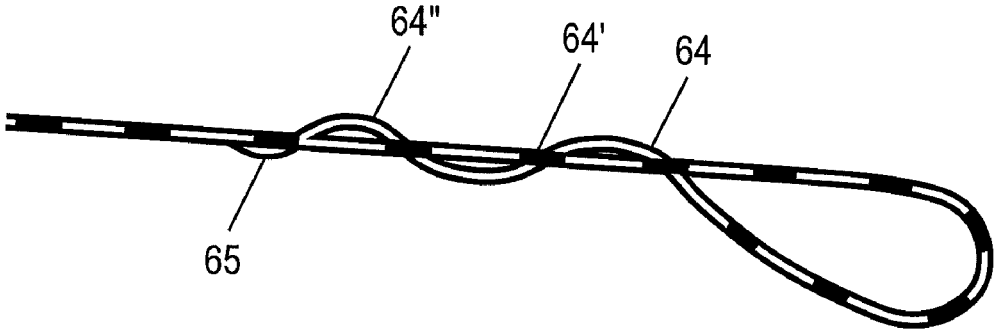
FIG. 19 shows a rope-like structure with looped-back end.

FIG. 19 shows a rope-like structure with a looped-back end. The end 65 has been looped through the openings 64, 64' and 64" and thus a loop has been formed which under tension has similar properties to those of spliced loops.

Figure 20:
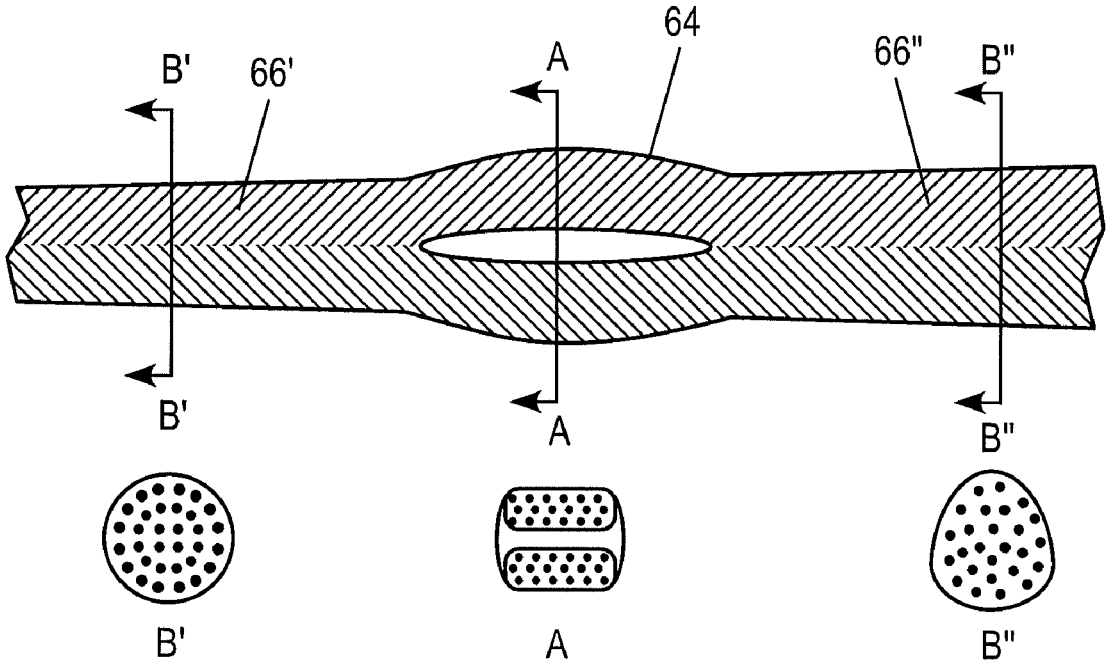
FIG. 20 shows a part of a rope-like article with cross sections.

FIG. 20 shows a part of a rope-like structure with cross sections. The opening 64 and the undivided areas 66' and 66" of the rope-like structure which border it are apparent. The opening 64 and the areas 66' and 66" include the cross sections A-A, B'-B' with cross section pictures A, B' and B". While the cross section pictures B' and B" indicate a round rope-like structure, for the cross section picture A a division and the resulting opening can be recognized.

Figure 21:
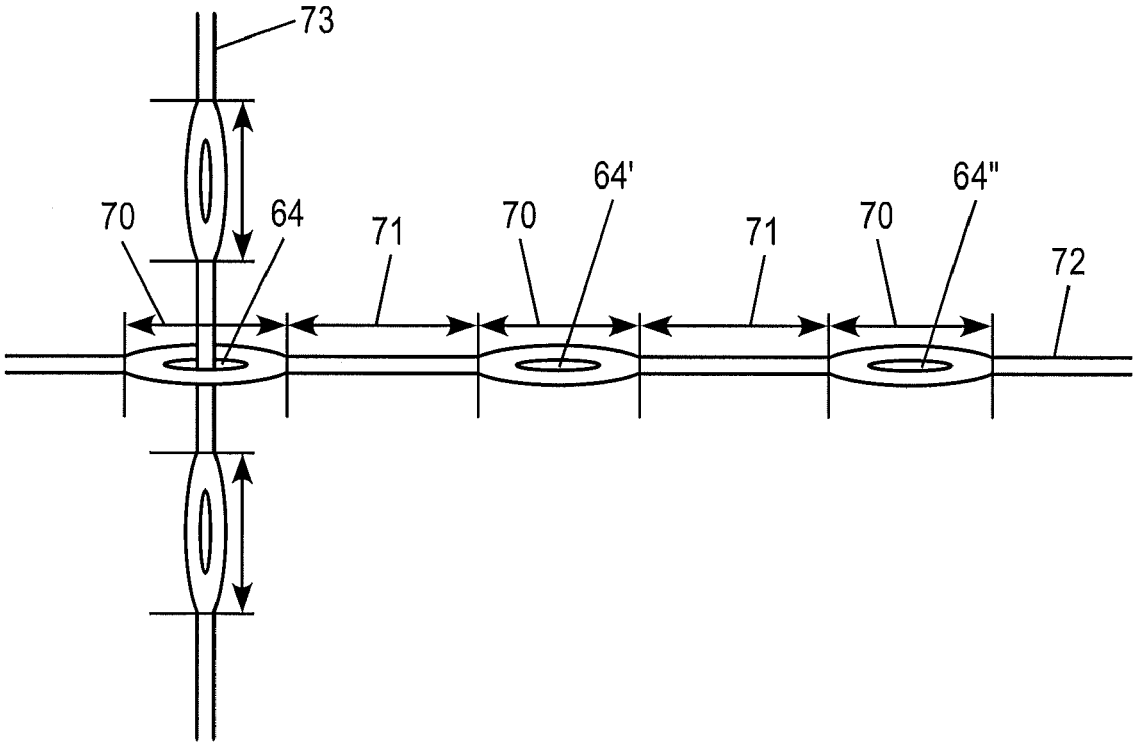
FIG. 21 shows a cord with openings arranged in a grid for low-slip stringing.

FIG. 21 shows a cord as a rope-like structure with openings arranged in a grid for low-slip strings. The structure of the cord or string corresponds roughly to FIG. 18. It is however designed for smaller diameters of 0.8-2.0 mm. The first sections 70 with the openings 64, 64' and 64" are followed by second sections 71 in which the cord is present braided as an undivided, rope-like structure, or as a 'one-piece'. The sections 70 and 71 follow one another in a certain given grid. A second cord 73 is located perpendicular to the first cord 72 horizontally and has been looped through the opening 64 of the first cord. The length L of the openings or slots has been selected such that the traverse cord in the tensioned state lies roughly in the middle. Likewise, the length of the sections 70 and 71, i.e. the grid dimension, is matched primarily to the dimension of the slots and secondarily to the tension regions and the materials used. The grid fluctuates for example from 3-30 mm, i.e. the slots follow one another at these intervals.

The second core 73 is arranged essentially perpendicularly to the first cord 72. It adjoins it and forms part of the strings. But strings can be used which allow the free spaces between the cords to appear as lozenges.

These arrangements of cores or strings are suited for stringing of any type, for example for games which use balls such as tennis, badminton, squash or golf. Due to this arrangement the cords or strings can hardly move even under extremely high frictional pressure or impact pressure. In this way improved tensioning of the racket surface can be achieved upon ball contact. The first and second cords can be, for example, generally of identical structure.

Figure 22:
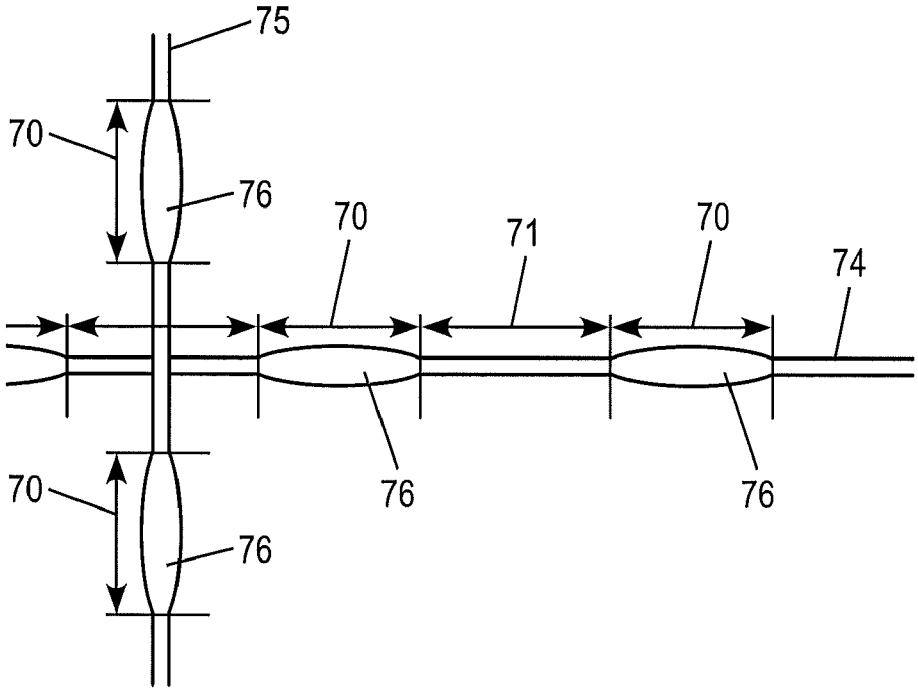
FIG. 22 shows a cord with thickened areas arranged in a grid for low-slip strings.

FIG. 22 shows a cord with thickened areas arranged in a grid for low-slip strings. The cord structure corresponds roughly to FIG. 21. The sections 70 and 71 follow one another in the first and second cords 74, 75 or strings. In the sections 71 the cord is made as an undivided rope-like structure, braided as a 'one-piece'. In sections 70 the cords have thickened areas 76 which are up to twice the diameter of the cord diameter in section 71. In this arrangement the lengths of the sections 70 and 71 and the grid size are matched to the tension ranges and the materials used. The grid fluctuates for example from 3-30 mm, i.e. the slots follow one another at these distances. The cords 74, 75 are essentially perpendicular to one another, in the tensioned state the middle regions of the sections 71 adjoining one another and forming part of the stringing.

These arrangements of cords or strings are suited for strings of any type, for example for games which use balls such as tennis, badminton, squash or golf. The cords or strings can only move insignificantly due to this arrangement even under extremely high frictional pressure and impact pressure. In this way improved tensioning of the racket surface is achieved upon ball contact. The first and second cords can be, for example, generally of identical structure in this version.

Core ropes claimed in the invention are used in industrial safety, in water sports, sailing and mountain climbing, and also in the police, fire department and military.

The disclosed ropes and cords can be used for recreation and hobbies, primarily as a replacement of braided or turned ropes.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

The invention claimed is:

1. Rope-like structure, comprising:

longitudinal fibers of a longitudinal fiber structure including individual fibers, yarns, yarn strands, and/or cords are processed among one another into a core, intermediate jacket and jacket, wherein there is at least one other fiber which lies transversely to the longitudinal fibers essentially with a different angle wherein the at least one other fiber is bound to the longitudinal fibers of the longitudinal fiber structure or another fiber bundle is attached around the longitudinal fibers, such that the latter are mutually slip-proof and essentially immovable and the longitudinal fibers being held fast in this way.

2. Rope-like structure as claimed in claim 1, wherein at least one longitudinal fiber of the longitudinal fiber structure is looped at least partially with the at least one other fiber and wherein the other longitudinal fibers are held fast in this way.

3. Rope-like structure as claimed in claim 1, wherein the longitudinal fibers of the longitudinal fiber structure are connected such that the at least one other fiber or fiber bundle runs in the transverse direction, diagonal direction, or at some other optional angle to the longitudinal fibers, wherein the at least one other fiber surrounds at least one longitudinal fiber or encloses it individually, entirely or partially, the at least one longitudinal fiber being held at a position within the longitudinal fiber structure and wherein the at least one other fiber is routed back so that it entirely surrounds individual longitudinal fibers and holds them essentially immovably and stationary in position against one another.

4. Rope-like structure as claimed in claim 3, wherein the structure does not unravel.

5. Rope-like structure as claimed in claim 3, wherein the structure has higher strength than a braided cord.

6. Rope-like structure as claimed in claim 1, wherein the structure has at least two locations at which the at least one other fiber loops around the longitudinal fibers of the longitudinal fiber structure or fiber bundle and is wrapped and routed back.

7. Rope-like structure as claimed in claim 1, wherein when cut, the structure is resistant to unraveling by the longitudinal fibers of the longitudinal fiber structure being held by the at least one other fiber or by the another fiber bundle, lying around the longitudinal fibers from outside to inside and from the inside to the outside.

8. Rope-like structure as claimed in claim 1, wherein under the longitudinal fibers of the longitudinal fiber structure at least one location within the longitudinal fiber structure, a longitudinal thread or a second longitudinal fiber with much higher strength than the longitudinal fibers is provided.

9. Rope-like structure as claimed in claim 1, wherein under the longitudinal fibers of the longitudinal fiber structure at least one location within the longitudinal fiber structure, a second longitudinal fiber with much higher elasticity and/or stretching than the longitudinal fibers is provided.

10. Rope-like structure as claimed in claim 1, wherein under the longitudinal fibers of the longitudinal fiber structure there is at least one second longitudinal fiber which is at least partially melted with heat with the longitudinal fibers and with the at least one other fiber or the another fiber bundle made at least partially as a melt fiber at least one location so that the longitudinal fibers of the longitudinal fiber structure are slip-proof.

11. Rope-like structure as claimed in claim 10, wherein the core and the jacket have the same or different longitudinal fibers of the longitudinal fiber structure, wherein outside longitudinal fibers are made at least partially as melt fibers, wherein the at least one other fiber or the another fiber bundle surrounds and binds the outside longitudinal fibers, and wherein a second at least one other fiber or a second another fiber bundle, present as a melt fiber, surrounds and binds the outside longitudinal fibers, the jacket formed of heat melted longitudinal fibers with the second at least one other fiber or the second another fiber bundle.

12. Rope-like structure as claimed in claim 1, wherein the least one other fiber or the another fiber bundle has higher strength compared to the longitudinal fibers of the longitudinal fiber structure and encloses and binds the longitudinal fibers differently.

13. Rope-like structure as claimed in claim 12, wherein the longitudinal fibers of the longitudinal fiber structure are mixed as core and jacket fibers, the jacket fibers forming a part of the core and the core fibers forming a part of the jacket, and wherein they are simultaneously bound by the at least one other fiber or the another fiber bundle having higher strength relative to the longitudinal fibers, the at least one other fiber or the another fiber bundle having different thickness, strength or extensibility than the longitudinal fibers.

14. Rope-like structure as claimed in claim 12, wherein the at least one other fiber or the another fiber bundle has higher elasticity relative to the longitudinal fibers of the longitudinal fiber structure and binds the longitudinal fibers and wherein the core consists of high-strength Aramid fibers and the jacket consists of heat-resistant Nomex fibers or of abrasion-resistant, cut-proof and/or flame-proof, heat-resistant, acid-resistant or UV-resistant fibers and/or yarns.

15. Rope-like structure as claimed in claim 12, wherein the least one other fiber or the another fiber bundle has higher elasticity relative to the longitudinal fibers of the longitudinal fiber structure and binds the longitudinal fibers, and wherein the core consists of extremely high-strength parallel fibers which are partially prestretched or oriented, and the jacket consists of UV-resistant, abrasion-resistant, cut-proof yarns and/or fibers, by which less stretching with higher flexibility results.

16. Rope-like structure as claimed in claim 12, wherein the longitudinal fibers of the longitudinal fiber structure in the core consist of high-performance fibers and/or cords with many fibrils and in the jacket of abrasion-resistant, cut-proof fibers resistant to moisture, wherein the fibers in the core and jacket are connected to one another by at the least one other fiber or the another fiber bundle such that even for the most varied fiber properties jacket slip does not occur and wherein at the same or reduced diameter higher damping of dynamic shocks is provided.

17. Rope-like structure as claimed in claim 12, wherein the core consists of various high-performance fibers with extremely low stretching and high tear strengths and the jacket consists of different, especially abrasion-resistant, edge-strong, cut-proof, heat-resistant, flame-resistant, UV-resistant fibers and wherein the longitudinal fibers are arranged as parallel as possible, the smallest possible stretching occurring in the longitudinal direction.

18. Rope-like structure as claimed in claim 12, wherein the longitudinal fibers of the longitudinal fiber structure in the core consist of extremely high-strength, high-performance fibers with much reduced stretching and higher tear resistance and in the jacket of abrasion-resistant, cut-proof fibers resistant to moisture, where the fibers in the core and jacket are connected to one another by the at least one other fiber or the another fiber bundle such that even for the most varied fiber properties jacket slip does not occur and wherein for this reason at the same or reduced diameter stretching as small as possible is provided.

19. Rope-like structure as claimed in claim 18, wherein at least the core fibers are present partially prestretched or oriented.

20. Rope-like structure as claimed in claim 12, wherein the longitudinal fiber structure in the core, intermediate jacket and jacket consists of different fibers, wherein in the intermediate jacket a damping cushion or an air cushion is formed and wherein the rope has a cavity in the middle of the core.

21. Rope-like structure as claimed in claim 12, wherein the structure has essentially a round cross section which changes in diameter in places and wherein the cross section passes in places into an oval and/or flat cross section.

22. Rope-like structure as claimed in claim 12, wherein lettering and/or marking and/or a middle marking is worked continuously into the outer surface of the structure by means of at least one second fiber or second fiber bundle in the longitudinal direction and/or in the transverse direction and/or at any angle to the longitudinal direction.

23. Rope-like structure as claimed in claim 1, wherein the at least are other fiber or the another fiber bundle forms an angle of less than 45° to the longitudinal fibers.

24. Rope-like structure as claimed in claim 1, wherein the at least one other fiber or the another fiber bundle forms an angle of 45° to 90° to the longitudinal fibers.

25. Rope-like structure, cord or rope as claimed in claim 1, wherein the structure includes at regular intervals, an undivided, braided rope-like structure with a diameter (D) and a divided, braided rope-like structure having openings with slot lengths (L).

26. Rope-like structure as claimed in claim 25, wherein an end of the rope is looped back repeatedly through the openings and forms a loop, the slot length (L) being 3-5 times the diameter (D) of the rope.

27. Rope-like structure as claimed in claim 1, including at regular intervals first sections having an undivided, braided rope-like structure and second sections having a divided, braided rope-like structure.

28. Rope-like structure as claimed in claim 27, wherein a second rope like structure is looped through an opening of the first rope like structure and located essentially perpendicular to it, the first and second rope like structures forming part of stringing.

29. Rope-like structure as claimed in claim 1, including at regular intervals, first sections having an undivided, braided rope-like structure and second sections having a braided, rope-like structure each with thickened areas, with diameters which are up to twice the diameter as the first sections.

30. Rope-like structure as claimed in claim 29, wherein a second rope like-structure is arranged essentially perpendicular to a first rope-like structure, the middle areas of the sections lying on one another and the first and second rope-like structures forming part of stringing.

31. Rope-like structure as claimed in claim 1, wherein the at least one other fiber is made as a fiber bundle.

32. Rope-like structure as claimed in claim 31, wherein the fiber bundle consists of monofil, multifil staple fibers or mixed fibers of different fibers, or of any combination of fibers, the fiber bundle being present twined, twisted or as parallel fiber bundles.

* * * * *

UNITED STATES PATENT AND TRADEMARK OFFICE

CERTIFICATE OF CORRECTION

PATENT NO. : 7,784,258 B2
APPLICATION NO. : 10/591254
DATED : August 31, 2010
INVENTOR(S) : Ruedi Hess It is certified that error appears in the above-identified patent and that said Letters Patent is hereby corrected as shown below:

Figure 7, please change “46” to --45--;

Column 1, line 51, please change “cores” to --cords--;

Column 2, line 6, please change “core” to --cord--;

Column 2, line 8, please change “core” to --cord--;

Column 2, line 50, please change “cores” to --cords--;

Column 3, line 16, please change “carabineers” to --carabiners--;

Column 3, line 66, please change “core” to --cord--;

Column 4, line 17, please change “core” to --cord--;

Column 4, line 35, please change “core” to --cord--;

Column 5, line 23, please change “Griion” to --Grilon--;

Column 5, line 28, please change “are” to --are an--;

Column 5, line 29, please change “and” to --and an--;

Column 5, line 30, please change “carabineers” to --carabiners--;

Column 6, line 66, please change “cable” to --rope--;

Column 7, line 7, please change “cores” to --cords--;

Signed and Sealed this
Eighteenth Day of January, 2011

David J. Kappos

David J. Kappos
*Director of the United States Patent and Trademark Office*

Column 7, line 33, please change “54′” to --54"--;

Column 8, line 34, please change “3.5 times” to --3-5 times--;

Column 8, line 52, please change “B′-B′” to --B′-B′ and B″-B″--;

Column 9, line 6, please change “core” to --cord--;

Column 9, line 10, please change “cores” to --cords--.